US007055419B2

(12) United States Patent
Sandberg

(10) Patent No.: US 7,055,419 B2
(45) Date of Patent: Jun. 6, 2006

(54) SYSTEM AND METHOD FOR OPTIMIZING SLICES FROM SLICING APPARATUS

(75) Inventor: Glenn Sandberg, Mokena, IL (US)

(73) Assignee: Formax, Inc., Mokena, IL (US)

( * ) Notice: Subject to any disclaimer, the term of this patent is extended or adjusted under 35 U.S.C. 154(b) by 0 days.

(21) Appl. No.: 10/409,857

(22) Filed: Apr. 9, 2003

(65) Prior Publication Data

US 2004/0134319 A1 Jul. 15, 2004

Related U.S. Application Data

(60) Provisional application No. 60/439,157, filed on Jan. 10, 2003.

(51) Int. Cl.
*B26D 7/06* (2006.01)

(52) U.S. Cl. ..... 83/75.5; 83/77; 83/107; 83/277; 83/932; 700/171

(58) Field of Classification Search ..... 83/365, 83/77, 54, 206, 277, 932, 107, 75.5; 700/171
See application file for complete search history.

(56) References Cited

U.S. PATENT DOCUMENTS

| | | | | |
|---|---|---|---|---|
| 2,950,640 | A * | 8/1960 | Camp | 83/29 |
| 3,466,958 | A * | 9/1969 | Munson | 83/76.4 |
| 4,114,492 | A | 9/1978 | Skidmore | |
| 4,532,840 | A | 8/1985 | Antonissen | |
| 4,534,002 | A * | 8/1985 | Urban | 700/171 |
| 4,805,500 | A * | 2/1989 | Saito et al. | 83/277 |
| 4,944,206 | A * | 7/1990 | Guy et al. | 83/42 |
| 5,226,334 | A * | 7/1993 | Pegoraro | 83/42 |
| 5,267,168 | A | 11/1993 | Antonissen et al. | |
| 5,481,466 | A | 1/1996 | Carey | |
| 5,937,080 | A * | 8/1999 | Vogeley et al. | 382/110 |
| 6,101,913 | A * | 8/2000 | Gahmberg et al. | 83/176 |
| 6,164,174 | A * | 12/2000 | Sigurdsson et al. | 83/13 |
| 6,460,440 | B1 * | 10/2002 | Tsune | 83/153 |
| 6,739,228 | B1 * | 5/2004 | Magnuson | 83/42 |
| 2004/0231480 | A1 * | 11/2004 | Wattles et al. | 83/401 |

FOREIGN PATENT DOCUMENTS

| | | |
|---|---|---|
| EP | 0713753 | 5/1996 |
| JP | WO 00/62983 | 10/2000 |

* cited by examiner

*Primary Examiner*—Kenneth E. Peterson
(74) *Attorney, Agent, or Firm*—The Law Office of Randall T. Erickson, P.C.

(57) ABSTRACT

A method for optimizing yield from a slicing apparatus, includes scanning and weighing a carcass, slab or loaf upstream of a slicing head of the slicing apparatus. The carcass, slab or loaf weight is divided by a desired pre-selected portion weight to determine the number of slices to be made. A remainder portion is allocated to an intermediate position along the carcass, slab or loaf to be sliced from the carcass, slab or loaf before a butt end portion, gripped by a gripper of the slicing apparatus, reaches the slicing head. The butt end portion is pre-arranged to be the desired pre-selected portion weight or at least an acceptable pre-selected portion weight. The butt end portion can then be released by the gripper as a desired or acceptable weight portion.

18 Claims, 4 Drawing Sheets

SYSTEM AND METHOD FOR OPTIMIZING SLICES FROM SLICING APPARATUS

The application claims the benefit of provisional application Ser. No. 60/439,157 filed Jan. 10, 2003.

TECHNICAL FIELD OF THE INVENTION

The invention relates to slicing systems for food products such as cheese, meat and pressed or molded meat products. The invention particulary relates to a slicing system that divides slabs or meat carcasses such as bacon bellies.

BACKGROUND OF THE INVENTION

It is known in Germany to divide bacon bellies into smaller portions or chunks for sale to a customer. The customer can then further slice or otherwise process these portions.

Referring to FIG. 1, according to a typical system, bacon bellies are fed through a slicing apparatus 6 while being gripped by a gripper 30 on the end farthest from the slicing blade 34, the "butt end" of the belly. The bellies are divided at increments to make acceptable slices or portions 10, 12, 14, 16, 18, 20 of desired target weights, such as 300 or 350 grams, until the butt end piece 22 is too short to sever a piece being of the desired target weight. It is possible that the butt end piece is heavier than the desired target weight but a forward length of the butt end piece cannot be severed due to the presence of the gripper. In practice, the rearmost portion 22*a*of the butt end piece 22, having a length 22*b* is engaged by the gripper and corresponds to about 140 grams of the butt end piece. Thus, the butt end piece can in fact be greater than say 300 grams but a 300 gram piece cannot be severed due to the presence of the gripper 30, i.e., the gripper 30 would interfere with the cutting blade 34. For example, a butt end piece could be 340 grams. Given an acceptable 300 gram slice, the rearmost 40 grams is insufficient to be engaged by the gripper during slicing off of the 300 gram slice. The entire butt end piece 22 (340 grams) is typically then redirected to a processing station where it is manually trimmed to 300 grams and reused as an acceptable slice with the remaining portion reprocessed or discarded. If the butt end piece is less than 300 grams it is reprocessed or discarded.

The present inventor has recognized the desirability of eliminating unnecessary manual steps and the desirability of optimizing the automatic sliced product output.

SUMMARY OF THE INVENTION

The present invention provides a method and apparatus for optimizing the sliced product from a carcass, slab or loaf.

According to the preferred embodiments of the invention, a carcass, slab or loaf is scanned and weighed upstream of the slicing apparatus. The carcass, slab or loaf weight is divided by a desired pre-selected portion weight to determine the number of slices to be made. A remainder portion is allocated to an intermediate position along the carcass, slab or loaf to be sliced from the carcass, slab or loaf before a butt end portion reaches the slicing head. The butt end portion is pre-arranged to be the desired pre-selected portion weight or at least an acceptable pre-selected portion weight.

The carcass, slab or loaf is sliced at incremental positions as the carcass, slab or loaf is advanced through the slicing apparatus to produce acceptable slices that are conveyed from the slicing apparatus. The remainder portion is sliced and removed from the carcass, slab or loaf before the butt end portion reaches the slicing blade. The remainder portion is removed for recycling or is discarded. After the remainder portion is removed, the butt end portion is released by the gripper and conveyed as an acceptable slice with the preceding acceptable slices.

By removing the remainder portion using the slicing head of the slicing apparatus and conveying the released butt end portion as a pre-determined acceptable slice, the step of manually removing the remainder portion from a butt end portion is eliminated.

As a further refinement of the invention, two or more pre-selected different slice weights can be removed from the carcass, slab or loaf and then classified downstream of the slicing apparatus. In this case, the number of slices of each weight taken from the carcass, slab or loaf can be optimized to use as much of the carcass, slab or loaf as possible, minimizing the remainder portion. The remainder portion is preferably removed before the butt end portion reaches the slicing blade, the butt end portion being pre-calculated to be equal to one of the two different slice weights.

Numerous other advantages and features of the present invention will be become readily apparent from the following detailed description of the invention and the embodiments thereof, the claims, and from the accompanying drawings.

DETAILED DESCRIPTION OF THE PREFERRED EMBODIMENTS

Figure 1:
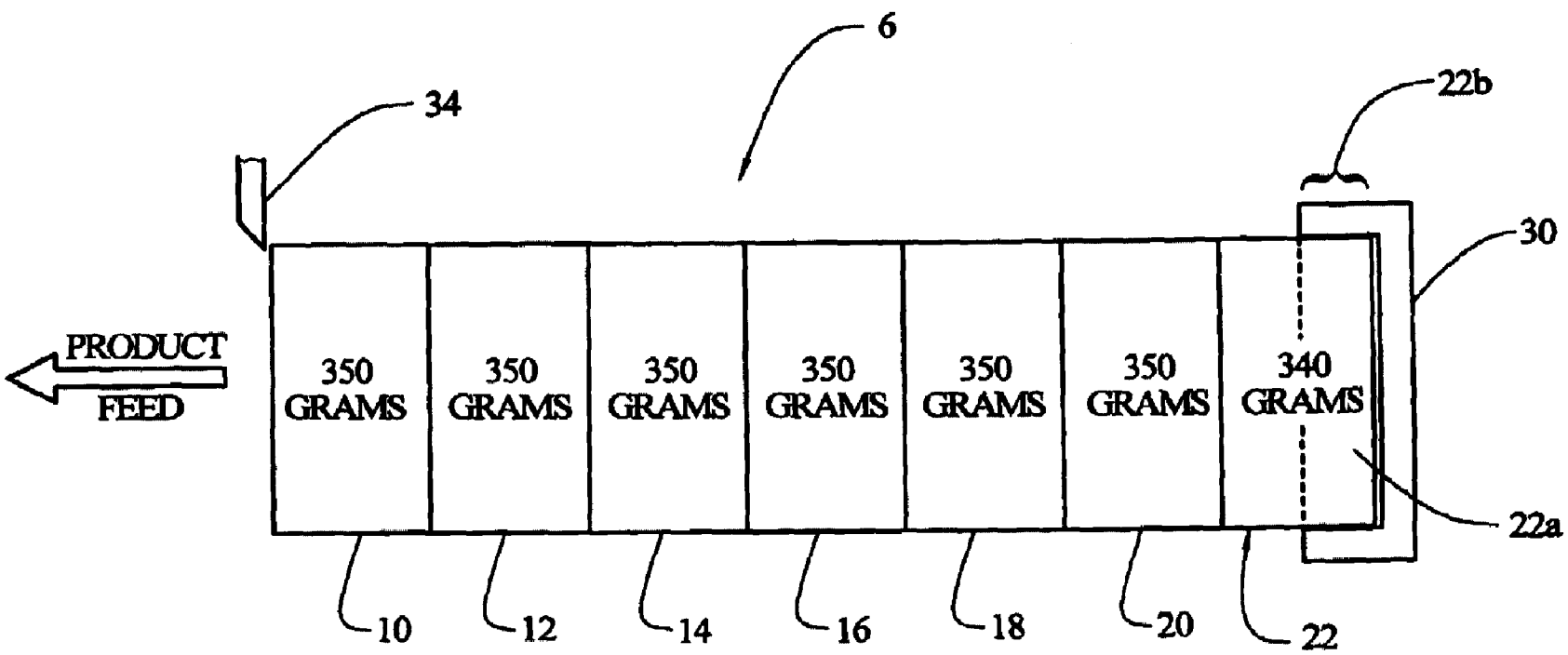
FIG. 1 PRIOR ART
FIG. 1 is a schematic diagram of a carcass, slab or loaf in a slicing apparatus showing the location of cut lines according to the prior art.

While this invention is susceptible of embodiment in many different forms, there are shown in the drawings, and will be described herein in detail, specific embodiments-thereof with the understanding that the present disclosure is to be considered as an exemplification of the principles of the invention and is not intended to limit the invention to the specific embodiments illustrated.

Figure 2:
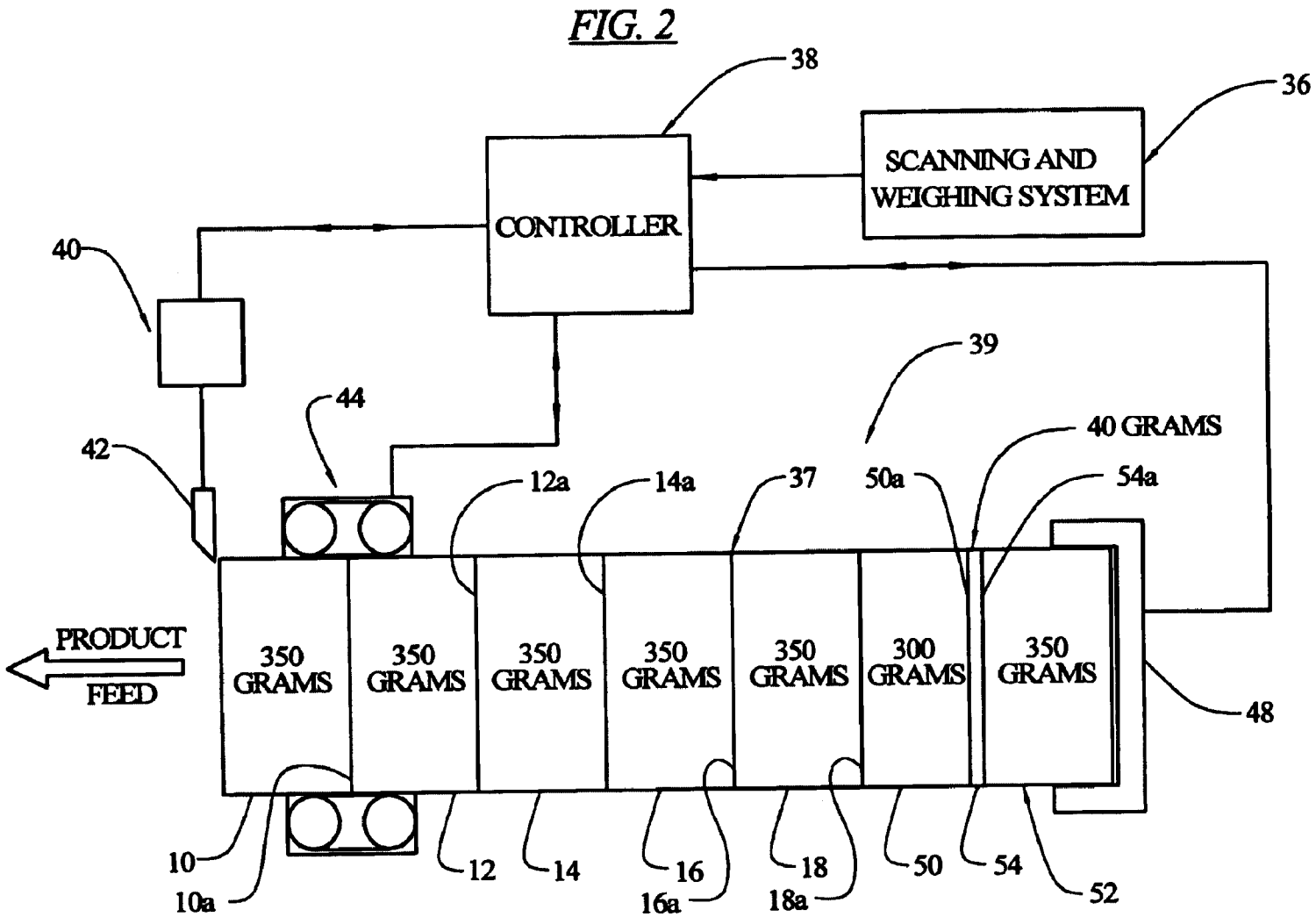
FIG. 2 is a schematic diagram of a carcass, slab or loaf in a slicing apparatus showing the location of cut lines according to the invention.

FIG. 2 demonstrates a first embodiment according to the invention wherein a typical 2440 gram bacon belly slab 37 is to be divided. A first target weight can be 350 grams and a second target weight can be 300 grams. Either target weight is an acceptable amount for packaging and sale. The slab 37 is shown located in a slicing apparatus 39.

A scanning and weighing system 36 weighs and profiles the slab 37 to be divided, before the slab is placed in the apparatus 39. The scanning and weighing system 36 can be an apparatus as disclosed in PCT/US00/10691 filed Apr. 20, 2000 or U.S. Ser. No. 09/959,876, filed Oct. 22, 2001, herein incorporated by reference and/or as sold commercially as a FORMAX SNS system manufactured by Formax, Inc. of Mokena, Ill., USA. The scanning and weighing system 36 is signal-connected to a controller 38. The controller 38 is signal-connected to a slicing blade drive 40 that controls a slicing blade 42, a conveyor drive system 44 and a gripper and drive system 48. The controller 38 determines each slice thickness according to the weight and profile of the slab, and adjusts the drives 40, 44, 48 to locate intermittent cut lines 10*a*, 12*a*, 14*a*, 16*a*, 18*a*, 50*a* and 54*a*. The slicing machine, including slice thickness control, can be of the type as described in U.S. Pat. Nos. 5,628,237; 5,649,463; 5,704,265; and 5,974,925; as well as patent publications EP0713753 and WO99/08844, herein incorporated by reference. The slicing machines can also be commercially available FORMAX FX180 and FORMAX SNS machines, available from Formax, Inc. of Mokena, Ill., U.S.A.

The controller 38 pre-calculates the optimal number of target weight slices to be cut from the slab 37 given a first preference for the first target weight and a second preference for the second target weight. According to the embodiment, a last slice having one of the pre-selected target weights is the butt end portion 52.

According to the illustrated embodiment, six portions 10, 12, 14, 16, 18, 52 have the first target weight of 350 grams, and one portion 50 has the second target weight of 300 grams. A remainder portion 54, in the illustrated example a 40 gram slice, is located before the butt end portion 52 and can be sliced and removed by the slicing blade 42.

The number of slices having the first target weight and the number of slices having the second target weight can be mathematically determined by the controller 38 given the weight and profile of the slab 37 to optimize the number of acceptable slices and to minimize the remainder portion 54.

Figure 3:
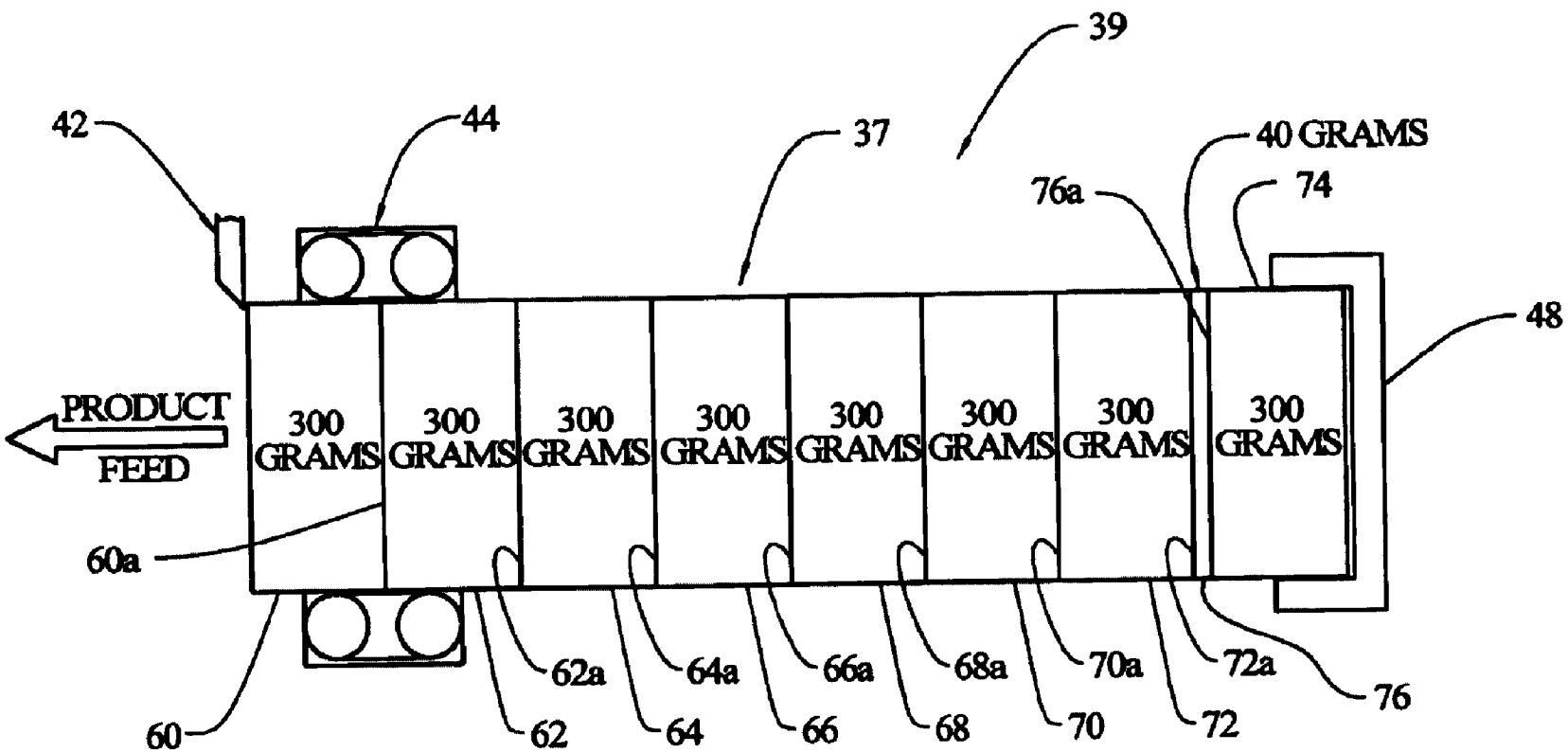
FIG. 3 is a schematic diagram of a carcass, slab or loaf in a slicing apparatus showing the location of alternate cut lines according to the invention.

FIG. 3 illustrates another embodiment wherein a 300 gram first preference target weight is used for the 2440 gram slab 37. According to this embodiment, 300 gram portions 60, 62, 64, 66, 68, 70, 72 and 74 can be sliced with a 40 gram remainder portion 76 to be recycled or discarded.

Figure 4:
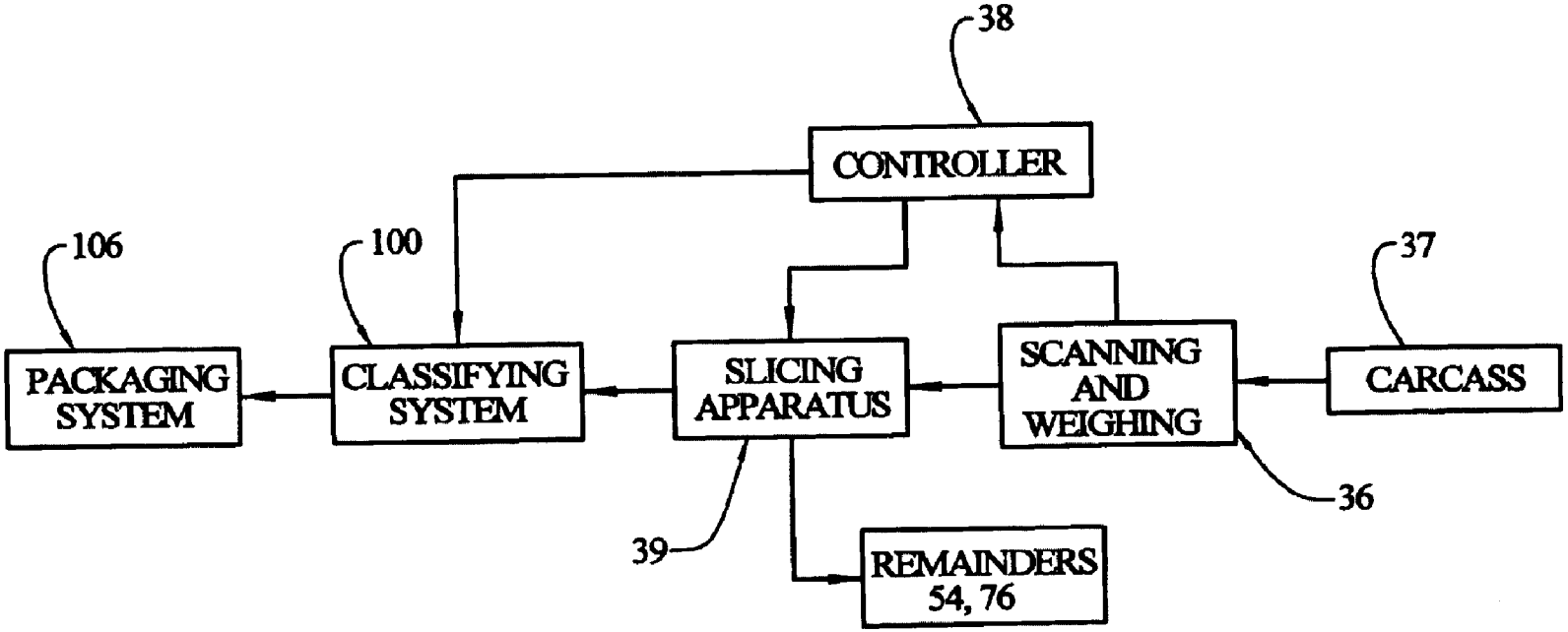
FIG. 4 is a schematic diagram of an overall system for optimizing slices according to the invention.

FIG. 4 illustrates the overall system in block diagram form. The carcass, slab or loaf 37 is first scanned and weighed by the scanning and weighing system. 36. The scanning and weighing system 36 sends carcass, slab or loaf profile and weight information to the slicing controller 38 which controls the slicing apparatus accordingly to slice the carcass, slab or loaf 37. The slicing apparatus discharges the remainder portions 54, 76 via an offload conveyor or a bucket. The acceptable slices, including the butt end portions 52, 74 are conveyed to a classifying system 100 such as described in U.S. Pat. No. 5,499,719 or of the type as described in U.S. Pat. Nos. 5,628,237; 5,649,463; 5,704,265; and 5,974,925; as well as patent publication EP0713753, herein incorporated by reference. The classifier can also be provided with the commercially available FORMAX FX180 and FORMAX SNS machines, available from Formax, Inc. of Mokena, Ill., U.S.A. Slices of different target weights, say 300 or 350, are classified, such as directed to different conveyers, accordingly. The slices are then conveyed to one or more packaging systems 106.

Using the two examples of FIG. 2 and FIG. 3 and comparing these examples to the typical prior art example of FIG. 1, an improved machine yield is demonstrated, the "machine yield" being defined as the aggregate weight of the acceptable slices delivered through the slicing apparatus divided by the total carcass, slab or loaf weight into the slicing apparatus.

FIG. 1: 2100 grams/2440 grams=86%

FIGS. 2 and 3: 2400 grams/2440 grams=98%

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A method of slicing a carcass, slab or loaf into slices, wherein the carcass, slab or loaf is held by a gripper at a butt end and driven into a slicer at a lead end, comprising the steps of:

pre-selecting at least one target weight defining an acceptable portion from the carcass, slab or loaf;

weighing the carcass, slab or loaf;

calculating a number of acceptable portions of said target weight and calculating a weight of a remainder portion less than said target weight that can be yielded by dividing said carcass, slab or loaf, said calculating steps all occurring prior to any slicing;

pre-arranging positions of cuts across the carcass, slab or loaf to slice said number of acceptable portions such that a last portion at said butt end gripped by said gripper is one of said acceptable portions;

gripping said butt end of the carcass, slab or loaf with a gripper that is movable with said carcass, slab or loaf;

driving said carcass, slab or loaf into a slicing plane;

slicing said carcass, slab or loaf at said positions of said cuts in said slicing plane, wherein said gripper moves with said carcass, slab or loaf as the carcass, slab or loaf is sliced;

releasing said gripper from an engagement with said butt end to release said last portion; and returning said gripper to a position to reload a subsequent carcass, slab or loaf.

2. The method according to claim 1, wherein said step of pre-arranging is further defined in that said remainder portion is pre-arranged to be adjacent to said last portion.

3. The method according to claim 1, wherein said at least one target weight comprises two target weights: a first target weight, and a lesser, second target weight.

4. The method according to claim 3, wherein said step of calculating is further defined in that of said first and second target weights the number of acceptable portions of the first target weight is maximized.

5. The method according to claim 4, wherein said step of calculating is further defined in that the number of first target weight acceptable portions and the number of second target weight acceptable portions are optimized to result in a remainder portion of minimum weight.

6. The method according to claim 3, wherein said first target weight is about 350 grams and said second target weight is about 300 grams.

7. The method according to claim 1, comprising the further step of scanning the carcass, stab or loaf to determine a weight distribution profile along the carcass, slab or loaf before the calculating step.

8. The method according to claim 1, wherein said carcass, slab or loaf is gripped only upstream of said slicer.

9. The method according to claim 8, wherein said step of pre-arranging is further defined in that said remainder portion is pre-arranged to be adjacent to said last portion.

10. The method according to claim 9, comprising the further step of scanning the carcass, slab or loaf to determine a weight distribution profile along the carcass, slab or loaf before the calculating step.

11. The method according to claim 1, comprising the further steps of:

conveying acceptable portions to one location;

conveying said remainder portion to another location; and releasing said last portion from said gripper and conveying said last portion to said one location.

12. The method according to claim 11 wherein said carcass, slab or loaf is gripped only upstream of said slicer.

13. The method according to claim 12, wherein said step of pre-arranging is further defined in that said remainder portion is pre-arranged to be adjacent to said last portion.

14. The method according to claim 13, wherein said at least one target weight comprises two target weights: a first target weight, and a lesser, second target weight.

15. The method according to claim 14, wherein said step of calculating is further defined in that of said first and second target weights the number of acceptable portions of the first target weight is maximized.

16. The method according to claim 15, wherein said step of calculating is further defined in that the number of first target weight acceptable portions and the number of second target weight acceptable portions are optimized to result in a remainder portion of minimum weight.

17. The method according to claim 16, comprising the further step of scanning the carcass, slab or loaf to determine a weight distribution profile along the carcass, slab or loaf before the calculating step.

18. The method according to claim 1, comprising the further steps of:

conveying acceptable portions to one location; and conveying said remainder portion to a different location.

* * * * *

UNITED STATES PATENT AND TRADEMARK OFFICE

CERTIFICATE OF CORRECTION

PATENT NO. : 7,055,419 B2
APPLICATION NO. : 10/409857
DATED : June 6, 2006
INVENTOR(S) : Glenn Sandberg It is certified that error appears in the above-identified patent and that said Letters Patent is hereby corrected as shown below:

At column 3, line 37, change "system." to --system--.

At column 4, line 50, change "stab" to --slab--.

Signed and Sealed this

Nineteenth Day of September, 2006

JON W. DUDAS
*Director of the United States Patent and Trademark Office*